United States Patent [19]

Liedtke

[11] 4,011,656

[45] Mar. 15, 1977

[54] HAIR CUTTER

[76] Inventor: Christa Liedtke, Weg zur Platte 72, 43 Essen-Bredeney, Germany

[22] Filed: June 20, 1975

[21] Appl. No.: 588,986

[30] Foreign Application Priority Data

June 26, 1974 Germany ..... 2430650

[52] U.S. Cl. ..... 30/30; 30/320

[51] Int. Cl.[2] ..... B26B 21/12

[58] Field of Search ..... 30/30, 31, 320, 335, 30/336

[56] References Cited

UNITED STATES PATENTS

| | | | |
|---|---|---|---|
| 2,404,141 | 7/1946 | Nelson | 30/320 X |
| 2,462,519 | 2/1949 | Mansfield | 30/30 |
| 2,580,276 | 12/1951 | Borgerding | 30/30 |
| 3,754,325 | 8/1973 | Tornvall | 30/30 |

FOREIGN PATENTS OR APPLICATIONS

| | | | |
|---|---|---|---|
| 968,945 | 12/1950 | France | 30/30 |

*Primary Examiner*—Gary L. Smith
*Attorney, Agent, or Firm*—Allison C. Collard

[57] ABSTRACT

A hair cutter comprising a cover plate displaceably disposed relative to and opposite a blade carrier plate, the cover plate having a row of teeth covering a blade cutting edge. Downwardly pointing teeth-like arresting projections are mounted on a flanged downwardly facing part of the blade carrier plate and positively engage upwardly pointing arresting teeth on lateral shoulders of a push button actuating element, the latter disposed perpendicular to the plane of the blade. The arresting projections are biased into an arresting position and are releasable by a push button actuating element which slidably projects through a complementary opening formed in the cover plate, whereby the arresting teeth of the shoulders being released from the downwardly pointing and complementary arresting teeth upon pushing the push button actuating element downwardly.

5 Claims, 6 Drawing Figures

HAIR CUTTER

The present invention relates to a hair cutting device, whereby a blade is interchangeably positioned between a blade carrier plate and an opposite cover plate which is displaceable between two end positions. The cover plate is provided with a row of teeth along the cutting edge of the blade and covering the cutting edge. The row of teeth act like a comb for the hair during the operation of the device, and engages the hair in the operating direction, i.e., vertically with respect to the cutting edge of the blade. The cutting length is adjustable by displacing the cover plate relative to the blade carrier plate so as to change the length of covering of the row of teeth over the cutting edge of the blade. For this purpose, teeth-like arresting shoulders are provided which are engaged by the cover plate so as to arrest and define the desired cutting length. The arresting means is actuated by an actuating means which is in a right angle oriented position relative to the plane formed by the blade which is pretensioned in the arresting position and is released from this position by the actuating means.

In my previous corresponding application Ser. No. 466,119, filed May 2, 1974, the actuating element which is in the form of a push button is guided by a pin extending from the blade carrier plate and extends into a longitudinal slot in the cover plate which permits the relative displacement of the cover plate with respect to the blade carrier plate. This arresting means provides a quick and simple selective positioning of the cover plate and thereby a selective adjustment of the teeth extension over the cutting edge of the blade. Since the push button element is not displaced with the cover plate, the user of the device must actuate the push button actuating element with one hand and must displace the cover plate with the other hand.

It is therefore an object of the invention to provide a device which is operable with one hand for adjusting the various desired cutting lengths, whereby the device forms a completely closed housing.

Based on the aforementioned device, the invention is characterized in that the push button actuating element extends through a complementary opening in the cover plate and is slidably mounted therewith. Laterally extending upwardly pointing arresting shoulders are provided which engage inwardly pointed complementary arresting shoulders which are mounted on a flange at the lower side of the blade carrier plate, whereby the arresting shoulders of the pretensioned push button element are pushed into positive engagement with the arresting shoulders of the row of teeth. The fixed shoulders are released by pushing the extending portion of the push button element which protrudes from the cover plate. Since the push botton actuating element is now displaced together with the cover plate, the displacement of the cover plate and the release of the push button element can now be carried out with one hand. Furthermore, the required slot in the cover plate of the older application is now eliminated, so that no cut-off hair or undesirable dust can penetrate into the inside of the device.

In a preferred embodiment of the invention, the cover plate is additionally provided with laterally extending pins at the rear range away from a slot and tongue connection which is an additional feature with respect to the device disclosed in the earlier application, wherein the cover plate is slidably guided in a recess of the blade carrier plate in the range of the teeth by means of the slot and tongue connection. The pins engage a guide groove in the opposite walls of the blade carrier plate. These additional rear pin connections do not only improve the guidance of the cover plate but also permit a fixed connection of the two plates with each other, whereby opening the device for exchanging blades is possible without difficulty. In accordance with the invention, the guide grooves are closed at their front ends and are somewhat longer than the engagement length of the slot tongue connection in the range of the row of teeth. Thereby, the rear pin groove connection permits a forward displacement of the cover plate by a length, such that the front of the slot tongue connection is released, whereby the cover plate is pivoted upwardly using the guide pins as the pivot point, thus exposing the inside of the device.

A further very important feature of this arrangement is that the guide pins act as abutments, in the closed position of the device, for the spring pretensioning for the push button actuating element in its pretensioned upward direction, and supporting the spring pretensioning on lateral shoulders on the blade carrier plate. Thereby, a downwardly directed reaction force is created in the range of the cover plate which is located in front of the push button actuating element, i.e., in the range of the row of teeth causing the blade cutting carrier plate to be rigidly clamped at the lower side of the row of teeth and the plate carrier plate. Such a rigid clamping of the blade cutting edge is necessary so as to assure a smooth and painless hair cutting and also considerably increases its use.

In order to facilitate the closing of the device after a blade has been inserted, it is recommended to bevel the upper side wall of the groove of the slot tongue connection at its free front end in such a way that the groove is widened with respect to the front end of the device which facilitates the inserting of the inner end of the spring.

Other objects and features of the presennt invention will become apparent from the following detailed description considered in connection with the accompanying drawings which disclose the embodiments of the invention. It is to be understood, however, that the drawings are designed for the purpose of illustration only and not as a limitation as to which reference should be made to the appended claims.

In the drawings, wherein similar reference characters denote similar elements throughout the several views.

Figure 1:
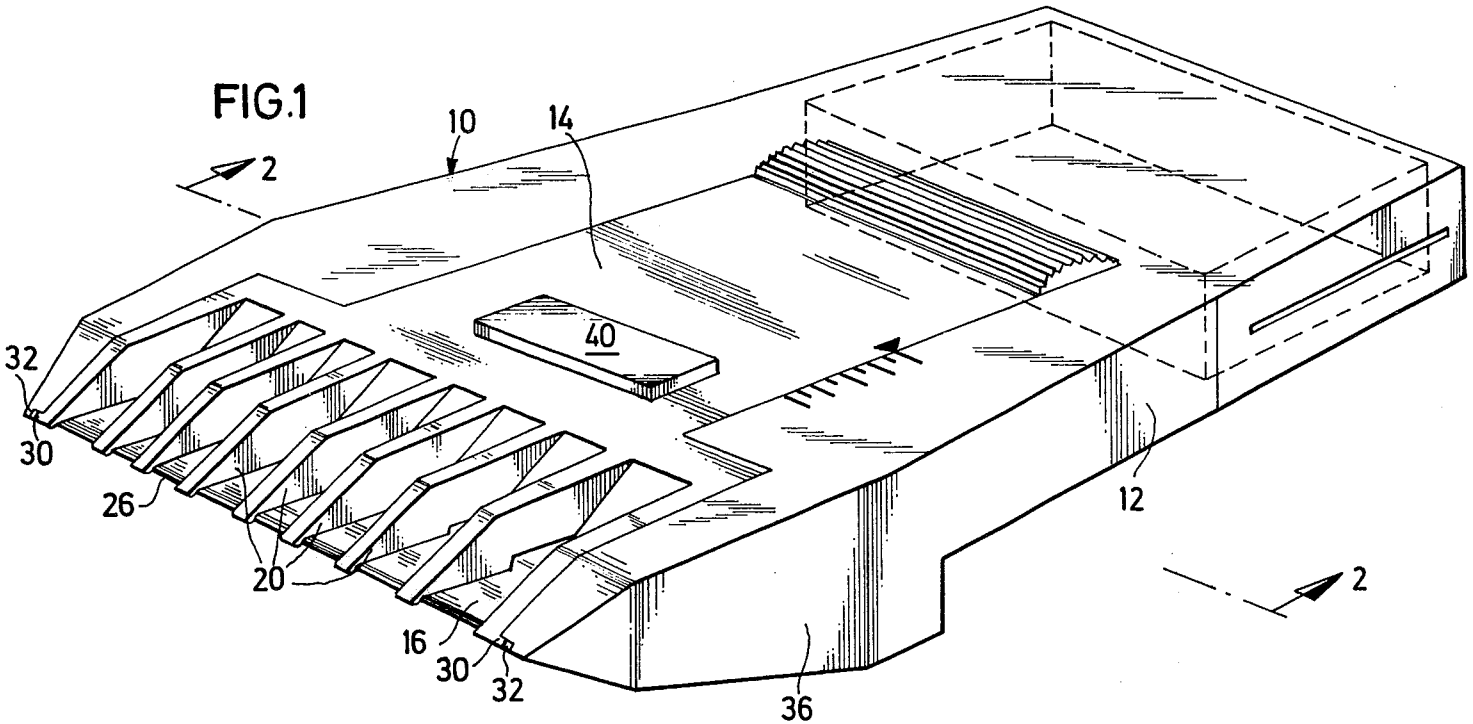
FIG. 1 is a perspective view of a preferred embodiment of a hair cutting device of the present invention.

Referring now to FIGS. 1–6, a hair cutting device 10 comprises a blade carrier plate 12 and a cover plate 14 and a blade 16 mounted therebetween. The longitudinally extending blade carrier plate 12 is provided with a recess 18 having a flat bottom 18' which is open at its front end and corresponds to the coutour of cover plate 14, the depth of the carrier plate corresponding to the thickness of the carrier plate 14. The carrier plate 14 is T-shaped in plane view, and at the upper lateral portion thereof a row of teeth 20 extends as a unit. The relatively small spaced teeth 20 of the row of teeth are beveled at their front ends, so that they form an acute tooth front edge 24 together with their associated flat lowerside 22 thereof which rest on the blade 16, whereby this front end easily penetrates the hair during operation of the device 10. The blade 16 is held in position on the bottom 18' of the recess 18 of the blade carrier plate 12 in such a manner that the cutting edge 26 protrudes somewhat over the front side of blade carrier plate 12. For purpose of a rigid support of the lowerside of blade 16, this front side either extends to the cutting edge 26, or has at least projections which extend to the proximity of the cutting edge 26. The mounting of the blade 16 of the flat bottom 18' of the blade carrier plate 12 is accomplished in known manner by providing two upwardly pointing pins 28 which engage complementary openings in the blade which is inserted into the device 10. The blade 16 which is mounted on the bottom 18' is fixedly pushed onto the bottom 18' by the lower side 22 of teeth 20 at the range of cutting edge 26 and at its rear range by the lower side of carrier plate 14, so that the blade 16 is securely supported on both sides when in operation. It is important that blade 16 is supported at its lower side by the blade carrier plate up to the immediate proximity of the ctting edge 26 while the front edge 26 of the teeth 20 protrudes somewhat over the cutting edge 26, i.e., also in the completely retracted shaving position of cover plate 14 as shown in FIG. 1. The cover plate 14 is displaceable between two end positions in the operating direction with respect to the blade carrier plate 12. The shown inner end position is the position wherein the device 10 is used for shaving, for example, the hair in one's neck. The outer end position (not shown), wherein the teeth 20 of the row of teeth assumes a maximum projection over the cutting edge 26 of blade 16, is the hair cutting position for cutting the hair at any given length. By the adjusting of the device 10 between any given position between these two end positions, any desired cutting length for the hair may be fixed.

It is important to note that the device engages the hair to be cut with the lower side of blade carrier plate 12, i.e., even in the shaving position, so that the user is never in doubt which side of the device has to be used for the particular cutting purpose. The displacement of cover plate 14 for changing the projecting teeth length is made possible by a slide guide in the form of a slot-tongue connection comprising a laterally projecting shoulder or joint tongue 30, respectively, which is positioned at the lateral outer edges of the two outermost teeth 20 of cover plate 14 and which extends to the front edge 24 and complementary groove 32 (see FIGS. 1, 3, 4 and 6) in the opposite side wall of recess 18. These side walls have a contour which corresponds to the teeth 20 of the coveer plate 14 and which protrude somewhat with respect to the front side of the blade carrier plate 12, which supports the lower side of the blade, so as to assure that the cover plate 14 protrudes over the cutting edge 26 of the blade 16. The arrangement of the tongue 30 at the outermost teeth 20 of the row of teeth or grooves 32, respectively, in the front end range of the blade carrier plate permits a sure guiding of both plates in the range of the blade which is clamped therebetween.

Figure 2:
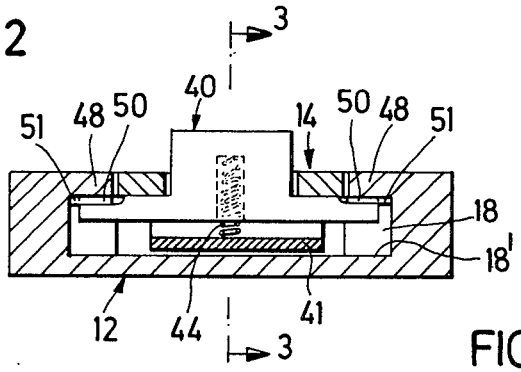
FIG. 2 is a sectional view taken along the lines 2—2 of FIG. 1.
Figure 3:
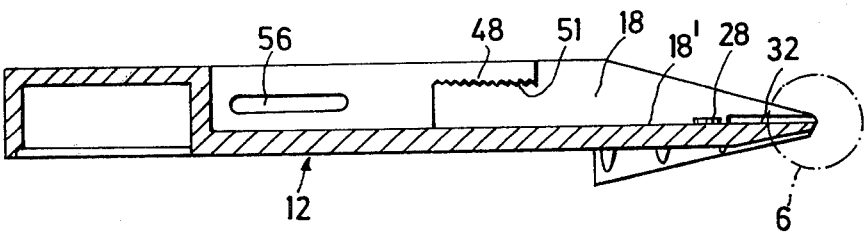
FIG. 3 is a section of the blade carrier plate taken along lines 3—3 of FIG. 2.
Figure 4:
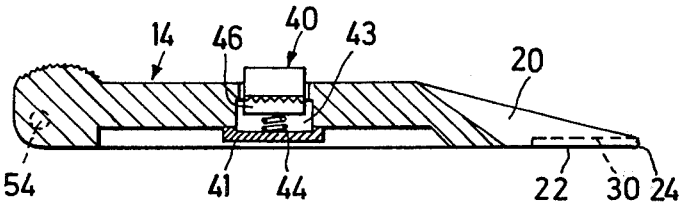
FIG. 4 is a section of the carrier plate taken along the lines 3—3 of FIG. 2.
Figure 5:
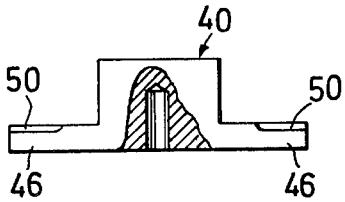
FIG. 5 is a partially broken side view of the push button actuating element of the arresting means of the hair cutting device.

For adjusting the cutting length for the hair, a push button actuated arresting means is provided which essentially comprises a push button actuating element 40 mounted in the cover plate 14 shown in FIGS. 2, 4 and 5. The push button actuating element extends into a corresponding opening 42 in the cover plate 14 and is held in free position with a mounting element 41 which is connected with the cover plate. A spring 44 which is retained between the push button actuating element 40 and the mounting element 41 pretensions the push button actuating element 40 in a direction of the cover plate. The substantially rectangular push button actuating element 40 is provided with shoulders 46 at two opposite sides which extend through lateral apertures 43 of the cover plate 14 and beneath a flange 48, and project inwardly from the blade carrier plate 12. The upper side of shoulders 46 as well as the opposing lower sides of the flange 48 are provided with equally spaced complementary teeth like arresting projections 50 or 51, respectively. The spring 44 which is retained in a bore of the push button actuating element 40 engages and retains shoulders 50 on shoulders 46 in fixed engagement with shoulders 51 of the lower side of the flange 48. By exerting a pressure on the upper side of the push button actuating element 40 and its subsequent downward movement, this fixed position is released, so that the cover plate 14 can be displaced with respect to the blade carrier plate. The power for releasing the arresting means is carried out with one hand by depressing the push button actuating element. As soon as the pressure on element 40 is disrupted, the arresting means automatically returns to its fixed position, due to the spring biasing.

In addition to the slot-tongue connection 30, 31, 32 at the front side of device 10, the cover plate 14 is connected with the blade carrier plate 12 by an additional slide guide at its rear end. This second slide guide essentially comprises guide pins 54 which project in opposite directions outwardly from the cover plate and engage grooves 56 which run in the direction of displacement of the cover plate which are provided in the side walls of recess 18 of the blade carrier plate 12. Grooves 56 have a length which assures that when displacing the cover plate into the utmost front position, the inner or rear end of the tongue 30 exits from the front end of the groove 32. Since the length of the flange 48 and the arrangement of the push button actuating element 40 in cover plate 14 are such that the shoulders 46 protrude in front of the flange 48 in the utmost front position of the cover plate, the front end of the cover plate can be lifted and pivoted upwardly using the guide pin as the pivot point, so that the inside of the device 10 is exposed for inserting or exchanging a blade or to remove any hair which may have penetrated into the inside of the device.

Figure 6:
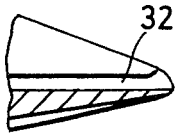
FIG. 6 is an enlarged partial sectional view of the area in the dash-point circle 6 of FIG. 3, which shows the front end of the blade carrier plate.

On the other hand, due to the location of the spring biased push button actuating element 40 between the two guides 30, 32 and 54, 56, the guide pins 54 act as abutments in the grooves 56 when the shoulders 46 are pressed on the lower side of the flange 48 by spring 44. The resulting reaction force pushes cover plate 14 downwardly in the range of the blade 16 and clamps the blade cutting edge 26 securely between the lower side 22 of the teeth and the bottom 18' of the blade carrier plate 12. This clamping force of the spring 44 substantially aids in a clean and painless operation of the device of the invention. Hence, the mounting of blade 16 in the slot-tongue connections 30, 32 must not necessarily have a press fit but may be relatively loose which is additionally advantageous, because the displacement of the cover plate after releasing the arresting means by pressing the push button actuating element 40, can be carried out without force, and without wear and tear of the guide. This is because, due to the pressing down of the push button actuating element, the spring pressure of shoulders 46 at the lower side of flange 48 is also released. In order to facilitate the insertion of the inner side of the tongues 30 after inserting or exchanging a blade 16, it is recommended to bevel the front ends of grooves 32 as shown in FIG. 6. Alternatively, the inner end of the tongues 30 (and/or the inner end of tongues 30 and the front end of grooves 32) may be beveled.

While only a few embodiments of the present invention have been shown and described, it will be obvious that many changes and modifications may be made thereunto without departing from the spirit and scope of the invention.

I claim:

1. A hair cutter comprising:

a blade carrier plate formed with a recess;

a cover plate;

guiding means for displaceably guiding said cover plate in said recess between two end positions, said guiding meand permitting displacement of said cover plate relative to said blade carrier plate only in one direction along said recess;

at least one blade having a blade cutting edge interchangeably retained between said blade carrier plate and said cover plate, said cover plate having a row of teeth which project beyond the cutting edge and are adapted when drawn through the hair to orientate the hair in the manner of a comb, and to engage the hair in operation perpendicularly relative to said blade cutting edge, the cutting length being adjustable upon displacement of said cover plate relative to the blade carrier plate in said one direction along said recess so as to change the length of projecting of said row of teeth over said blade cutting edge;

inwardly pointed arresting teeth being mounted on a flanged downwardly facing side of said blade carrier plate;

a push button actuating element having a projecting portion projectingly extending through a complementary opening formed in said cover plate and slidably mounted therein for displacement of said push button actuating element relative to both the cover plate and the blade carrier plate in a second direction transverse to said one direction, said push button actuating element having laterally extending shoulders with upwardly pointing arresting teeth for operatively engaging said inwardly pointed arresting teeth of said blade carrier plate so as to arrest and define a desired cutting length;

spring means for biasing said push button actuating element in the arresting position with its upwardly pointing arresting teeth operatively engaging said inwardly pointed arresting teeth, whereby said shoulders are released from said inwardly pointed arresting teeth and said cover plate is free to be displaced together with said push button actuating element in said one direction upon pushing said projecting portion of said push button actuating element.

2. The hair cutting device as defined in claim 1, wherein said guiding means comprises:

tongue-groove connection means extending in said one direction adjacent said row of teeth, guide pins laterally projecting from said cover plate in the rear region remote from said tongue-groove connection means, and guide groove means, and guide groove meand formed in opposite walls of said blade carrier plate in which said guide pins operatively engage.

3. The hair cutter according to claim 2, wherein said guide groove means are closed at front ends thereof and are somewhat longer than an engagement length of said tongue-groove connection means in said range of said row of teeth.

4. The hair cutter according to claim 2, wherein said tongue-groove connection means comprises two tongues and upper guide walls defining two grooves, said upper guide walls are beveled at front free ends for facilitating the insertion of inner ends of said tongues in said two grooves.

5. The hair cutter according to claim 2 further comprising spring means operatively proping-up said laterally extending shoulders, disposed between said tongue-groove connection means and said guide pins, and biasing said push button actuating element in an upward direction; and said guide pins in a closed position of said cutter constitute operative abutment means for said spring means, such that a downwardly directed reaction force is created in a range in front of said cover plate adjacent the range of said row of teeth for fixedly clamping said blade cutting edge between a lower side of said row of teeth and said blade carrier plate.

* * * * *